United States Patent [19]

Conti

[11] Patent Number: 4,461,392

[45] Date of Patent: Jul. 24, 1984

[54] THREADED PLASTIC BOTTLE CAP

[75] Inventor: Vincent N. Conti, West Hempstead, N.Y.

[73] Assignee: American Safety Closure Corp., Farmingdale, N.Y.

[21] Appl. No.: 390,803

[22] Filed: Jun. 22, 1982

[51] Int. Cl.[3] ..... B65D 53/00

[52] U.S. Cl. ..... 215/270; 215/344; 215/DIG. 1

[58] Field of Search ..... 215/270, 344, DIG. 1, 215/329

[56] References Cited

U.S. PATENT DOCUMENTS

| | | | |
|---|---|---|---|
| 3,203,571 | 8/1965 | Plunkett | 215/344 |
| 3,568,871 | 3/1971 | Livingstone | 215/344 |
| 4,061,240 | 12/1977 | Brownbill | 215/270 |
| 4,143,785 | 3/1979 | Ferrell | 215/270 |

*Primary Examiner*—Donald F. Norton

*Attorney, Agent, or Firm*—Pennie & Edmonds

[57] ABSTRACT

Imrpoved plastic bottle cap having a primary annular sealing flange depending from the top wall of the cap for engagement with the top wall surface of the bottle neck of the bottle. The flange is flexible and wide enough to cover a major portion of the top wall surface so as to thereby accommodate surface irregularities. The cap also has a secondary annular sealing flange extending radially downwardly from the top wall of the cap for engagement with the outer side wall of the bottle neck.

7 Claims, 3 Drawing Figures

THREADED PLASTIC BOTTLE CAP

BACKGROUND OF THE INVENTION

The present invention relates to threaded plastic bottle caps for use with bottles containing a carbonated beverages or a liquid under vacuum. The cap is particularly suited for bottles containing carbonated beverages. In the past bottle caps for liquids such as carbonated beverages have been constructed of metal. Typically, these caps have been secured to the bottle by crimping or by constructing the cap with a skirt portion and forming a thread in the skirt. Usually the thread is formed in place on the bottle neck, using the threaded neck of the bottle as a die. Each of these cap constructions includes a liner disposed inside the cap for effecting a seal with the bottle neck. Also with both constructions the cap is deformed while on the bottle neck to secure it to the bottle and assure proper sealing. This forming of the cap on the bottle tends to avoid any problems that might be incurred because of bottle defects, irregularities, or variations in size due to manufacturing tolerances.

More recently there has been some use of plastic caps for bottles containing carbonated beverages or liquids under vacuum. These plastic caps are constructed with preformed threads and secured onto the bottle by simply threading the cap onto the threaded neck of the bottle. Since no deforming of the cap is employed once the cap is on the bottle neck, tolerance variations in the bottle manufacturing or in the cap manufacturing can become critical as far as effecting a proper seal. The molding of plastic caps can be done with great accuracy. Also the molding of plastic bottles can be done with accuracy. With glass bottles however, the tolerance variations are quite large and with today's normal production techniques, one cannot be assured of having bottles with neck configurations of precise shape and size. Not only are bottle manufacturing tolerances quite wide for glass bottles, such bottles are subject to chipping and other damage during handling. These problems with tolerances and irregularities encountered with glass bottles have in turn made it difficult to construct a plastic cap which is capable of use with such bottles where the contents are a carbonated beverage or one being packaged under vacuum. In both situations it is essential that a complete seal be formed between the bottle and the cap in order to maintain the carbonation or vacuum condition inside the bottle.

Plastic bottle caps which have been constructed for use with glass bottles have been made with specific sealing members inside the cap for effecting a seal with the bottle and for accommodating irregularities or wide tolerances in the bottle neck configuration. U.S. Pat. No. 4,143,785 discloses a plastic cap construction particularly suited for glass containers in which the contents is to be maintained under vacuum. In order to accommodate bottles with variations in wall thickness at the neck, the cap is provided with two sealing flanges on its interior which are adapted to engage with the inside and outside edges at the top of the bottle neck. These flanges are constructed in such a way that they flex as the cap is screwed down onto the bottle neck. In this way they can accommodate variations in the wall thickness of the bottle neck and provide a linear seal along the inner and outer edges of the neck.

Plastic caps have also been constructed with internal sealing members in the form of plugs which are adapted to be inserted into the interior of the bottle neck and engage against the inner wall surface of the bottle neck. Constructions of this type are disclosed in U.S. Pat. No. 4,090,631 and U.S. Pat. No. 4,322,012. The primary sealing of these caps is effected by the plug member which is constructed to flex and thereby accommodate variations in bottle tolerances Still another plastic cap construction for glass bottles is disclosed in U.S. Pat. No. 4,061,240. In this cap, a flexible sealing member is provided on the interior of the cap. The sealing member is itself provided with a series of annular rings adapted to seat on the top of the bottle neck. As the cap is screwed down onto the bottle neck, the flexible member positions itself on the top of the bottle neck. Final threading causes a support member disposed above this sealing member to engage the sealing member and press it, and more specifically the annular rings, tightly against the top of the bottle neck. To further assure sealing of the annular rings against the top of the bottle neck, spaces are provided in the upper support to permit the pressurized atmosphere to escape over the top of the sealing member where it can exert a downward pressure on it. This cap is quite complicated in its construction. Segmented support members are provided to mechanically push the sealing member against the top of the bottle and channels must be formed in the cap structure to permit the pressurized atmosphere to act against the sealing member. Also the sealing rings which actually engage against the top of the bottle neck provide only a limited area of contact and thus may not be capable of providing a complete seal in any situation where the top of the bottle neck contains irregularities in its surface.

SUMMARY OF THE INVENTION

A plastic bottle cap constructed in accordance with the teachings of the present invention provides for resilient sealing with the top wall surface of the threaded neck of the bottle. For this purpose, the cap has a primary annular sealing flange extending downwardly from the top wall of the cap for resilient contact with the top wall surface of the bottle neck. This flange is of considerable radial length so as to cover most of the top wall surface of the bottle neck and it is flexible enough to take up any irregularities in the top wall surface of the bottle neck against which it engages. When the cap is fully threaded onto the bottle neck, the primary sealing flange is biased in an upwardly direction to create a resilient seal between the flange and the area of contact with the top surface of the bottle neck.

Directly above the primary sealing flange, the inner surface of the top wall of the cap is provided with an annular groove. This groove is dimensioned to receive the primary sealing flange as it is biased upwardly during tightening of the cap onto the bottle neck. The flange construction and groove are correlated so that a space is left above the flange when the cap has been fully tightened onto the bottle. This space provides an area in communication with the pressurized atmosphere of the bottle. Such pressurized atmosphere will then act against the sealing flange and press it against the top wall surface of the bottle neck. This assures contact of the flange over any irregularities in the top wall surface of the bottle neck.

A second annular sealing flange also extends downwardly from the top wall of the cap. This flange provides a secondary seal and engages with the outer side wall of the bottle neck.

The two sealing flanges together define an annular chamber between them which is isolated from the interior of the bottle when the cap is fully threaded onto the bottle neck. Where the bottle is to contain a liquid under vacuum conditions, a vacuum will also be created in the chamber between the two sealing flanges. This aids in the sealing effectiveness of the cap to the bottle. Where the bottle is to contain a carbonated beverage, the chamber between the two sealing flanges is also effective in further isolating the bottle interior from the outside atmosphere.

DESCRIPTION OF THE PREFERRED EMBODIMENT

Figure 1:
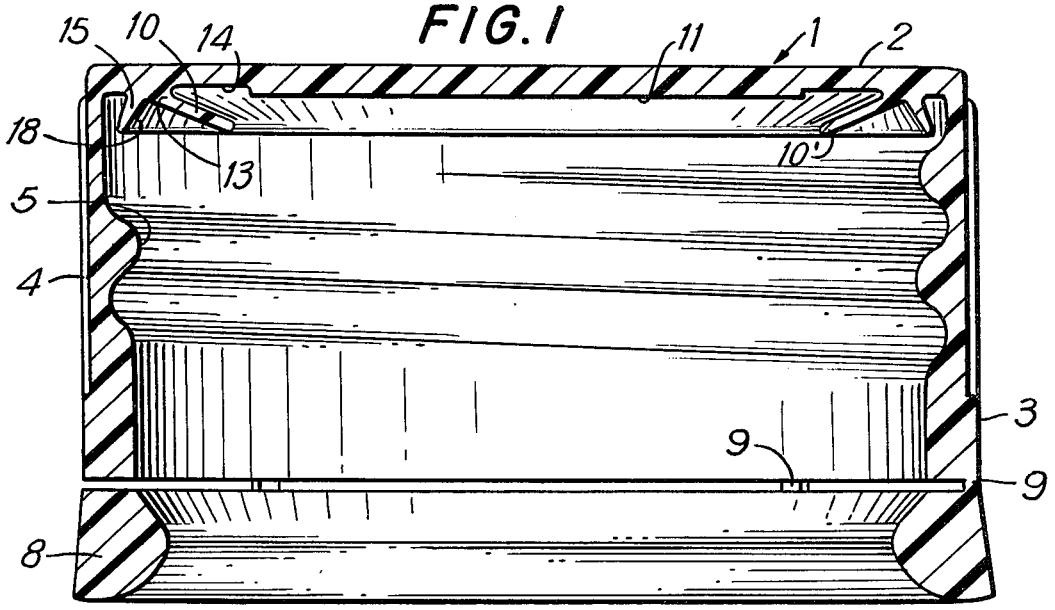
FIG. 1 is an enlarged cross-sectional view of the cap of the present invention.
Figure 2:
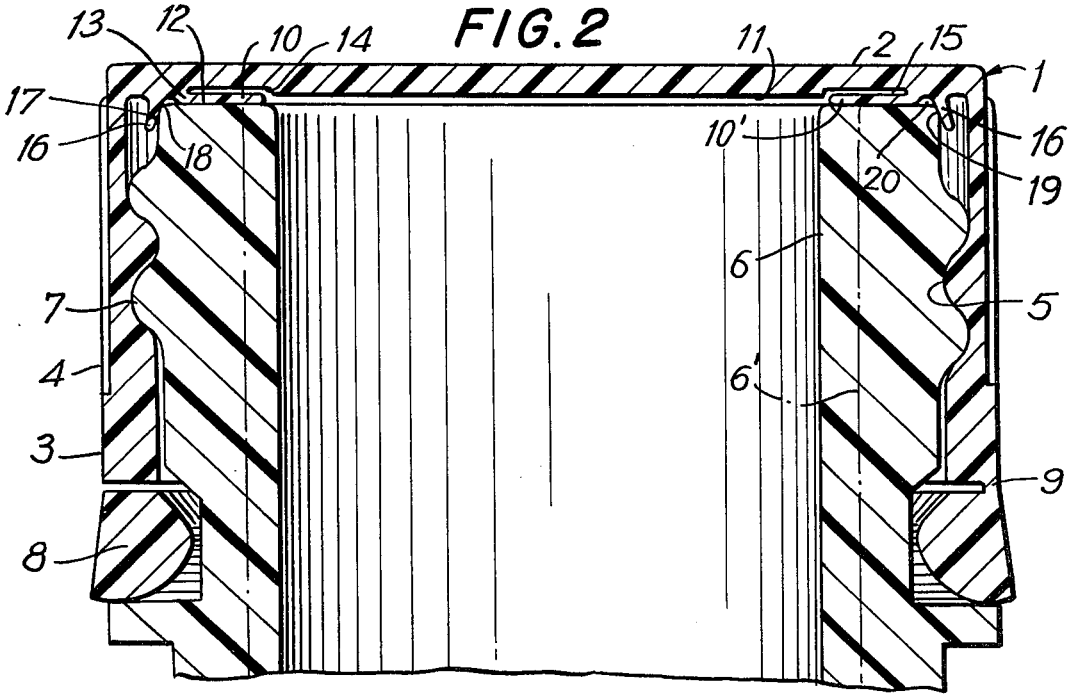
FIG. 2 is an enlarged cross-sectional view of the cap shown in FIG. 1 in its fully threaded position on the neck of a bottle.

The cap of the present invention generally designated at 1 comprises a top 2 and side wall 3. The side wall defines the skirt portion of the cap extending parallel to the longitudinal axis of the cap and includes on its outer surface a knurled region 4. This is provided for assisting the user in turning the cap onto and off of the bottle with which it is to be used. The inner surface of the wall 3 of the cap is provided with a threaded portion 5 for securing the cap to a bottle. FIG. 2 shows the neck 6 of a bottle with external threads 7 which cooperate with the internal threads 5 of the cap. Attached to the bottom portion of the skirt cap is a tamper-proof ring 8. Attachment is by frangible members 9. The ring is adapted to automatically tear away from the skirt upon unthreading of the cap from the bottle so as to show that the bottle has been opened.

In accordance with the teachings of the present invention, the cap is provided with a primary sealing flange 10 extending downwardly from the bottom surface 11 of the top wall of the cap. This sealing flange is annular in shape and disposed near the periphery of the cap so as to align itself with the top wall surface 12 of the neck of the bottle as more fully described below. The sealing flange extends radially downwardly and inwardly from the top wall of the cap and is adapted to be biased upwardly as the cap is threaded onto a bottle to provide a biased contact with the top wall surface of the bottle neck.

The length of the sealing flange in the radial direction facilitates proper engagement with the top wall surface of the bottle neck. As shown in the drawings, the radial extent of the flange is such as to cover a major portion of the upper surface area of the top wall of the bottle neck. Thus, any deep irregularity in this surface will be spanned or bridged by the sealing flange. The sealing flange also has a thickness which is thin enough so that it is quite flexible and capable of easily adapting itself or contouring itself to the top wall surface of the bottle neck regardless of irregularities in this surface. The length and flexibility of the sealing flange permit it to effect sealing contact with the top wall surface in a direction extending completely around the bottle neck regardless of surface irregularities.

The sealing flange 10 has a base end 13 which extends below the bottom surface 11 of the top wall of the cap. As most clearly shown in FIG. 3, this base end engages against the top surface 12 of the bottle when the cap is threaded fully onto the bottle neck. The base end is of sufficient rigidity whereby this engagement limits further axial movement of the cap downwardly onto the bottle neck.

Radially inwardly of the base portion of the sealing flange 10, the surface 11 of the cap is provided with an annular groove 14. This groove is axially aligned directly above the sealing flange 10 and extends radially inwardly of the free end 10' of the flange. The thickness of the sealing flange and the depth of the groove are correlated so that when the cap is fully threaded onto the bottle neck with the base end 13 engaged against the top surface 12 of the bottle neck, a space 15 is formed immediately above the sealing flange, which space is in communication with the interior of the bottle neck. More specifically, the base end 13 of the sealing flange has a thickness as measured axially of the cap from the bottom of the groove 14 which is greater than the thickness of the portion of the flange axially aligned with the groove.

With the space above the flange communcating with the interior of the bottle, sealing of the flange 10 is enhanced by the fact that the pressurized atmosphere within the bottle will act on the upper surface of the flange and press it firmly against the top wall surface of the bottle neck. This assists in contouring the flange to any irregularities in the top wall surface of the bottle neck.

The cap shown in the drawings is a 28 mm cap commonly used with bottles containing a carbonated beverages. With such a cap, the sealing flange 10 is constructed with a thickness of about 0.012 inches and a length, as measured in the radial direction from the base to the free end of the flange, of about 0.150 inches. The base end extends axially below the surface 11 of the top wall of the cap by about 0.010 inches while the depth of the annular groove 14 is about 0.006 inches. With this construction, a cap fully tightened onto the bottle neck will have a clearance of 0.01 inch from the bottom surface 11 of the cap and there will be a space of about 0.004 inches in the annular groove above the flange.

The radial length of the primary sealing flange is not only sufficient to bridge irregularities in the upper surface of the bottle neck, it is also of such a length as to accommodate wide bottle manufacturing tolerances. As shown in solid lines in FIG. 2, the inner wall surface 6 of the bottle has a diameter which is less than the internal diameter formed by the free end 10' of the primary sealing flange. The flange, however, is also suitable for sealing against a bottle having a larger internal diameter such as indicated in FIG. 2 by the inner wall surface shown in broken lines 6'. With such a bottle, the primary sealing flange extends radially inwardly of the inner wall surface 6'. Nevertheless, a sufficient area of contact of the sealing flange with the top wall surface 12 of the bottle neck is provided to assure a proper seal.

In addition to the primary sealing flange 10, the cap constructed according to the teachings of the present invention includes a secondary sealing flange 16. This flange is disposed radially outwardly of the primary sealing flange and extends downwardly and outwardly from the bottom surface 11 of the top wall of the cap. Its function is to engage with the outer wall surface 17 of the bottle neck immediately adjacent the outer edge 18 of the top wall surface of the bottle neck. As with the primary sealing flange 10, the secondary sealing flange is of a thickness whereby it is flexible. It is tapered in cross-section orientation on the cap so that its inner surface 19 will engage the outer surface 17 of the bottle neck as the cap is threaded onto the bottle neck.

With a 28 mm cap, the secondary sealing flange will have a length of about 0.062 inches and will extend downwardly with its inner surface 19 at an angle of about 30° from the longitudinal axis of the cap. This angle is sufficient to permit the secondary sealing flange to accommodate tolerance differences in the outside diameter of different bottle necks. It is important that the construction of the secondary sealing flange permits the flange to pivot rather than flatten out as it engages the outer wall surface of the bottle neck in sealing contact therewith.

Figure 3:
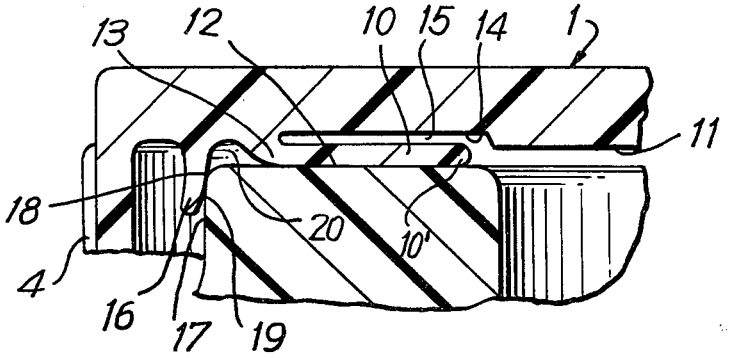
FIG. 3 is an enlarged cross-sectional view showing the sealing flanges of the cap as they cooperate with the neck of the bottle.

As shown in FIG. 3, the final position of the cap produces an annular chamber 20 disposed between the two sealing flanges and along the top wall surface 12 of the bottle neck at a location immediately adjacent the outer edge of the top wall surface. This chamber is formed due to the angled shape of the base end of the primary sealing flange and its engagement with the top wall surface of the bottle neck at a location disposed radially inwardly of the outer edge of the top wall surface. With vacuum filled bottles, this space will contain a vacuum and provide an additional barrier between the interior of the bottle and ambient atmosphere. Also, where the bottle is filled with a carbonated beverage, the area 20 will further act to separate the interior of the bottle from the exterior and permit the sealing flanges to operate independently.

I claim:

1. An improved bottle cap for use with a bottle having a threaded neck opening into the bottle, said cap being constructed of flexible plastic material and having a top wall, a cylindrical side wall depending from the top wall and a thread on the inner surface of the side wall for cooperating with the thread on the neck of the bottle, the improvement comprising:

(a) a primary annular sealing flange extending downwardly from the top wall of the cap in a radial inward direction for engagement with the top wall surface of the bottle neck as aligned directly therebelow when the cap is threaded onto the bottle neck, said primary sealing flange:

(1) being biased in an upwardly direction by contact with the top wall surface of the bottle neck when the cap is fully threaded onto the bottle neck, (2) having a radial length sufficient to cover a major portion of the surface area of said top wall surface and span surface irregularities therein, and (3) being sufficiently flexible to accommodate such surface irregularites and maintain sealing contact with the top wall surface in a direction extending completely around said bottle neck; and (b) an annular groove in the inner surface of the top wall of the cap axially aligned directly above the primary sealing flange and extending radially inwardly of the free end of the flange for reception thereof when the cap is fully threaded onto said bottle neck, (1) said groove having a depth sufficient to leave the upper surface of the primary flange free of contact with any other cap structure and to leave a space above said sealing flange which is in communication with the interior of said bottle neck when the cap is fully threaded thereon so as to permit pressurized atmosphere in the bottle to act on the upper surface of said sealing flange to press it against the top wall surface of the bottle neck.

2. The improvement in the bottle cap according to claim 1 wherein:

(a) the radially outwardmost base end of said primary sealing flange is located radially outwardly of the groove in the top wall of the cap and has a thickness as measured axially of the cap from the bottom of the groove which is greater than the thickness of the portion of the flange axially aligned with the groove.

3. The improvement in the bottle cap according to claim 2 wherein:

(a) the base end of the primary sealing flange is of sufficient rigidity when engaging against the top wall surface of the bottle neck to prevent further tightening of the cap onto the bottle neck.

4. The improvement in the bottle cap according to any one of claim 1, 2 or 3, further comprising:

(a) a secondary annular sealing flange extending downwardly from the top wall of the cap in a radially outward direction for engagement with the outer wall surface of the bottle neck immediately adjacent the outer edge of the top wall surface of the bottle neck.

5. The improvement in the bottle cap according to claim 4 wherein:

(a) said secondary sealing flange extends downwardly at an angle as measured from the longitudinal axis of the cap, which is sufficient to accommodate tolerance differences in the outside diameter of different bottle necks and effect sealing contact with the outer wall surface thereof.

6. The improvement in the bottle cap according to claim 5 wherein:

(a) said secondary sealing flange is tapered in cross-section; and (b) the inner surface thereof extends at an angle of about 30° relative to the longitudinal axis of the cap.

7. The improvement in the bottle cap according to claim 6 wherein:

(a) the primary sealing flange engages the top wall surface of the bottle neck radially inwardly of the outer edge thereof; and (b) the base end of the primary sealing flange is shaped to provide an annular chamber between the primary and secondary sealing flanges which overlies the top wall surface of the bottle neck immediately adjacent the outer edge thereof when the cap is fully threaded onto the bottle neck.

* * * * *